United States Patent [19]

Savoye et al.

[11] 4,232,245

[45] Nov. 4, 1980

[54] REDUCED BLOOMING DEVICES

[75] Inventors: Eugene D. Savoye, Lancaster; Thomas W. Edwards, Mt. Joy; Lloyd F. Wallace, Coatsville, all of Pa.

[73] Assignee: RCA Corporation, New York, N.Y.

[21] Appl. No.: 838,713

[22] Filed: Oct. 3, 1977

Related U.S. Application Data

[63] Continuation of Ser. No. 620,750, Oct. 8, 1975, abandoned.

[51] Int. Cl.[3] ..... H01J 29/44

[52] U.S. Cl. ..... 313/367; 357/31

[58] Field of Search ..... 313/367

[56] References Cited

U.S. PATENT DOCUMENTS

| | | | |
|---|---|---|---|
| 3,548,233 | 12/1970 | Cave et al. | 313/367 |
| 3,755,015 | 8/1973 | Redington et al. | 357/31 |
| 3,761,762 | 9/1973 | Henry et al. | 315/10 |
| 3,786,294 | 1/1974 | Wilson et al. | 313/367 |
| 3,792,197 | 2/1974 | Chai | 313/367 |

OTHER PUBLICATIONS

Singer, et al., "Theory, Design, and Performance of Low-Blooming Silicon Diode Array Imaging Targets," IEEE Trans. on Electron Devices, vol. ED-21, #1, Jan., 1974.

Douglas, "High Light-Level Blooming in Silicon Vidicon," IEEE Trans. on Electron Devices, vol. ED-22, #5, May, 1975.

Noda, et al., "An Economical Color Television Camera Utilizing a Silicon Vidicon for Electronic Color Separation," IEEE Trans. on Electron Devices, vol. ED-22, #5, May, 1975.

*Primary Examiner*—Robert Segal

*Attorney, Agent, or Firm*—Eugene M. Whitacre; Glenn H. Bruestle; Vincent J. Coughlin, Jr.

[57] ABSTRACT

A target for vidicons and image intensifier tubes include a potential barrier less than about 1500 Å from an input signal sensing surface. The targets also include various passivation means for stabilizing the energy level configuration along the input signal sensing surface by substantially fixing the valence or conduction band along that surface relative to the Fermi level.

12 Claims, 8 Drawing Figures

REDUCED BLOOMING DEVICES

This is a continuation of application Ser. No. 620,750, filed Oct. 8, 1975 now abandoned.

BACKGROUND OF THE INVENTION

The invention relates to sensing devices incorporating single crystal semiconductor wafers.

Sensing devices such as silicon vidicons and silicon intensifier tubes employ sensing elements or targets consisting of single crystal semiconductor wafers. The operation of such sensing elements in these devices is well known in the art. One problem associated with their operation is that certain elemental signal areas of the sensing elements may become overly excited by an incident image signal. As a consequence of such overexcitation, charge carriers in excess of the signal handling capabilities of the wafer may be generated at certain localized regions of the sensing element or wafer. The excess charge carriers diffuse laterally to adjacent regions of the wafer, causing a loss of imaging capability in the neighboring regions of the wafer as evidenced by an undesired "blooming" or overloading of the target in the localized region.

One technique for controlling blooming is described in "Theory, Design, and Performance of Low-Blooming Silicon Diode Array Imaging Targets" by B. M. Singer and J. Kostelec in *IEEE Trans. on Electron Devices,* vol. ED-21, pp. 84–89, January 1974, herein incorporated by reference. In this technique, a wafer is proposed having a controlled energy level configuration and surface recombination velocity wherein a potential barrier is incorporated into the wafer at an unstated depth from its major input signal sensing surface. The doping level controls the height of the potential barrier. This potential barrier in normal operation allows a limited number of excited minority carriers to penetrate to the input signal sensing surface and then recombine, thereby maximizing the sensitivity of the device by permitting the greater majority of excited minority carriers to diffuse toward a charge storage region of the wafer along a major surface opposite the sensing surface of that wafer. However, in the case of the generation of excess carriers by over-excitation at localized regions (normally associated with the blooming condition previously described) the excess carriers accumulate at and overcome the potential barrier. These excess carriers are swept to the sensing surface where they quickly recombine due to the substantially increased recombination velocity along that surface, thereby avoiding lateral diffusion to other neighboring regions of the target.

Ideally, the energy level configuration (and the potential barrier) necessary for accomplishing the noted blooming reduction mechanism can be controlled by carefully depositing a fixed number of donors or acceptors to a specified depth of the sensing element or wafer by suitable techniques such as, for example, ion implantation. However, in order to maximize the sensitivity of imaging devices such as, for example, silicon vidicons, it is also necessary to locate the potential barrier as close to the major input signal sensing surface as possible. The sensitivity of the device to strongly absorbed input signals, such as blue or ultraviolet light, in particular, is reduced in accordance with the distance of the potential barrier to that surface. Unfortunately, in practical devices, certain processing methods, and variables associated therewith, in the manufacture of the sensing element or wafers requires that the barrier potential be located sufficiently distant (on the order of 3000 Å) from the sensing surface to isolate or minimize the effect of those methods upon the barrier potential necessary for controlling blooming. Otherwise, it has been found that undesirable levels of dark current, and inadequate blooming control occurs. Undesirable and uncontrollable variations or instabilities also occur in the dark current and blooming control performance during manufacture or assembly. Furthermore, noncontrollable variations in processing reduce the manufacturing yield of useable wafers having the desired non-blooming characteristics to uneconomical levels. Such problems notwithstanding, it is desirable to provide controllable potential barriers of the type described at distances of less than about 1500 Å from major input signal sensing surfaces to maximize the sensitivity characteristics of the ultimate device and yet provide blooming control with low dark current.

SUMMARY OF THE INVENTION

A sensing device includes a single crystal semiconductor wafer having a potential barrier with a controlled energy level configuration within about 1500 Å from an input signal sensing surface. The sensing device also includes a means for passivating the energy level configuration along the input signal sensing surface to the wafer for avoiding surface effects which would otherwise effect the energy level configuration in the region of the potential barrier.

DESCRIPTION OF THE PREFERRED EMBODIMENTS

General Structure

Figure 1:
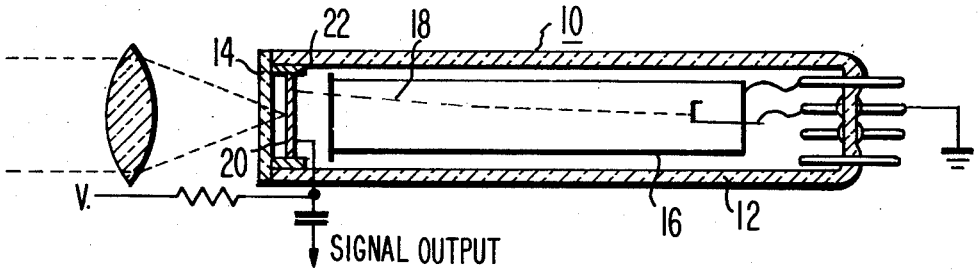
FIG. 1 is a longitudinal sectional view of an improved vidicon camera tube utilizing the invention.

A preferred embodiment of the invention is a vidicon type camera tube 10 as shown in FIG. 1 having an evacuated envelope 12 and including a transparent faceplate 14 at one end of the envelope 12, and an electron gun assembly 16 inside the envelope 12 for forming a low velocity electron beam 18. An input signal sensing element or target 20, mounted on a ceramic spacer 22, is positioned adjacent the inside surface of the faceplate 14 in a manner suitable for receiving a light input image signal. Means (not shown) for magnetically focusing the beam 18 toward the target 20 and for causing the beam 18 to scan the surface of the target 20 may be disposed outside the envelope 12.

The photon-excitable target 20, a fragment of which is shown in FIG. 2, is a wafer-shaped silicon photodiode target having a bulk region 24 of a single crystal of elemental silicon with first and second opposed major surfaces 26 and 28, respectively. The first major surface 26 comprises the input signal sensing surface of the target 20 for receiving on input light image. The second major surface 28 faces the electron beam, when mounted in the tube of FIG. 1, and is referred to, for simplicity, as the scan surface of wafer 24.

The wafer 24 includes a charge storage region "B" along a surface portion including the scan surface 28, and and an input surface region "A" along the surface portion including the input signal sensing surface 26. The charge storage region "B" includes on the scan surface 28 of the silicon wafer 24, an array of discrete PN junction storage diodes 30. An insulating layer 32 of silicon dioxide is provided on the scan surface 28 between the discrete diodes 30 to shield the bulk 24 from the effects of the scanning electron beam 18. Contact pads 34 of P-type silicon are provided which cover the P-type surfaces of the discrete diodes 30 and overlap the insulating layer 32 about the periphery of the diode 30 in a manner well known in the art. Such pads 34 improve the contacts of the scanning beam 18 with the diodes 30.

Figure 2B:
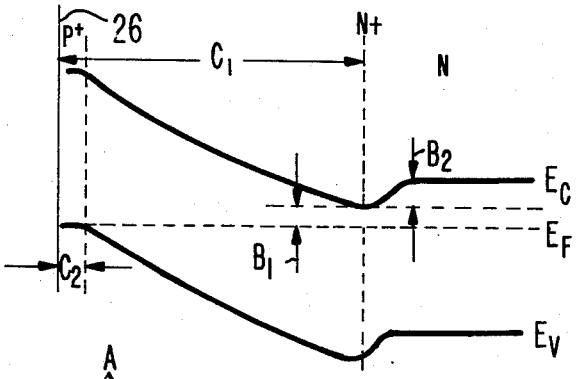
FIGS. 2*b* and 3*b* depict band diagrams showing the energy level configurations in the regions of the input signal sensing surface regions of the targets shown in FIGS. 2*a* and 3*a*, respectively.

Along the input surface region "A", extending from the input signal sensing surface 26 into the bulk of the silicon wafer 24, there is provided an energy level configuration of the silicon wafer 24 such as substantially shown in FIG. 2*b*. A P+ region 40 is provided along the input signal sensing surface 26 which effectively fixes the valence band $E_V$ in that region of the target 20 substantially at the Fermi level $E_F$. An N+ potential barrier is provided a distance of $C_1$ from the input signal sensing surface 26 for accomplishing blooming control. $C_1$ represents the distance from the surface 26 to the peak of N+ distribution. The N+ potential barrier is preferably located such that $C_1$ is less than about 1500 Å. The distribution of the doping profile in the region of the N+ potential barrier relative to the N-type bulk of the silicon wafer 24, should have the characteristics ($B_1$ and $B_2$) necessary for achieving the blooming reduction mechanism described in the aforementioned article by B. M. Singer et al.

Figure 2A:
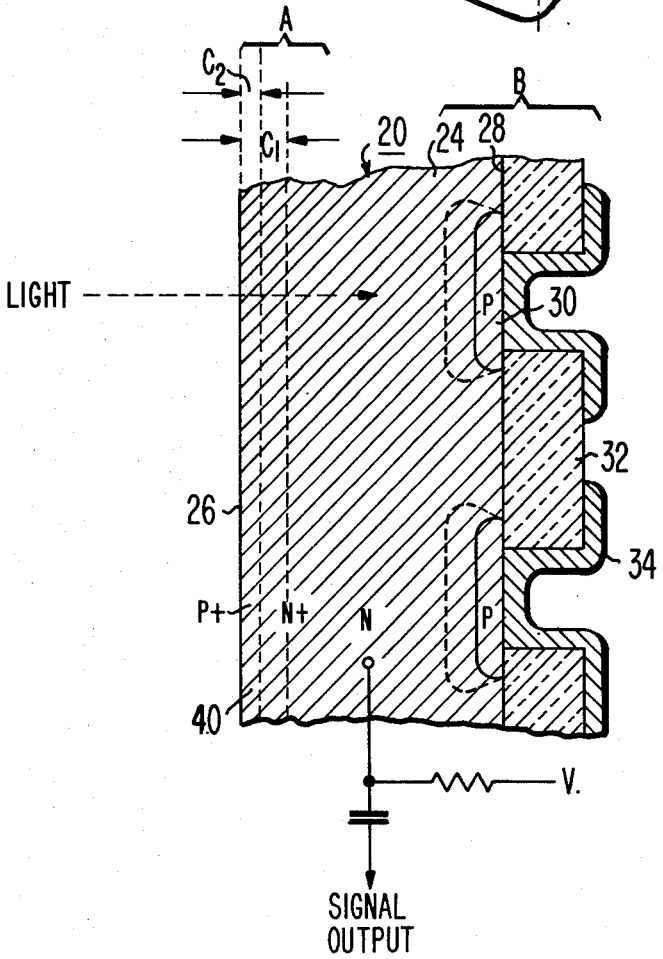
FIGS. 2*a* and 3*a* are enlarged fragmentary sectional views of alternative sensing elements or targets suitable for use in the tube of FIG. 1.
Figure 3B:
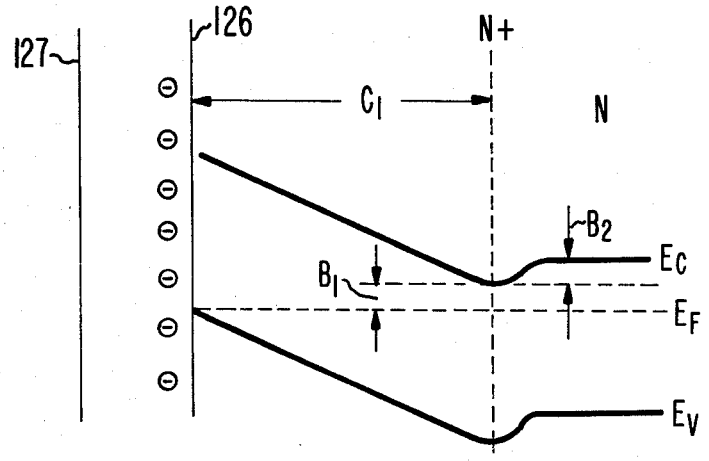
Figure 3A:
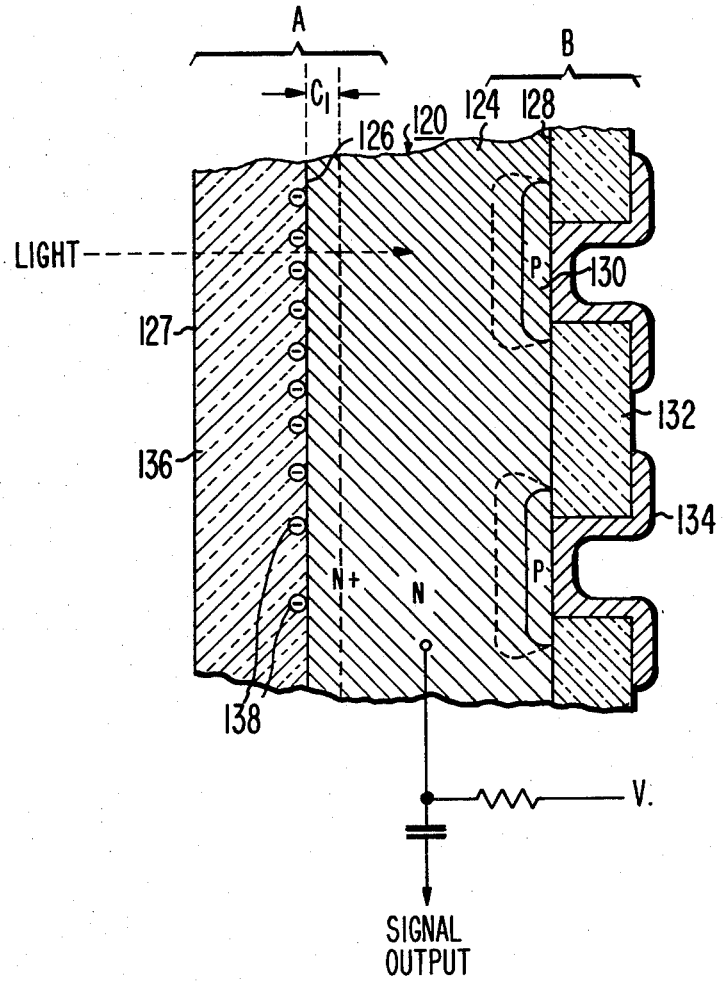

Referring to FIGS. 3*a* and 3*b*, there is shown an alternative embodiment 120 of the target 20 (FIG. 2*a*) wherein similar numbers designate corresponding portions of each target except that the first digit of each designation number is varied to identify each of the various embodiments. Referring to FIG. 3*a*, there is provided a layer of transparent insulating material 136, along the input signal sensing surface 126 of the semiconductor wafer 124, including sufficient non-mobile negative charge 138 for inducing or causing an inversion behavior along that surface whereby a P+-like region is provided along the input signal sensing surface 26 by field-effect, effectively fixing the valence band $E_V$ in that surface region of the wafer 24, substantially at the Fermi level $E_F$. The doped P+ region 40 shown in the embodiment of FIG. 2*a* is omitted. In other respects, the target 20 is substantially similar to that shown in FIG. 2*a*. The energy level configuration of the target 120 extending into the bulk of the silicon wafer 24 from an exposed surface 127 of layer 136 is substantially as shown in FIG. 3*b*.

Figure 4:
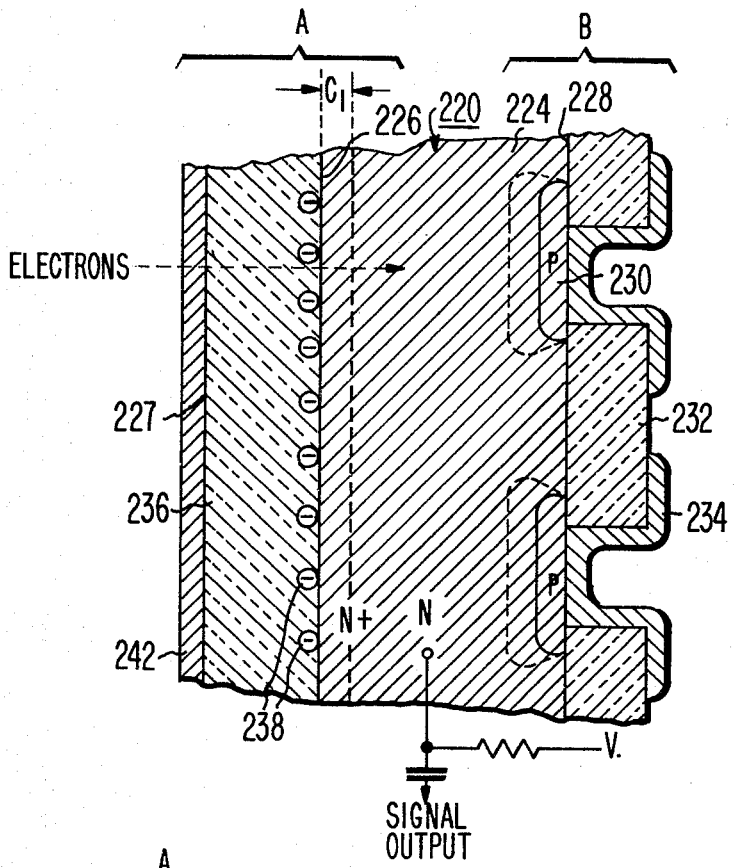
FIGS. 4 and 5 are enlarged fragmentary sectional views of alternative sensing elements or targets suitable for use in image intensifier tubes.
Figure 5:
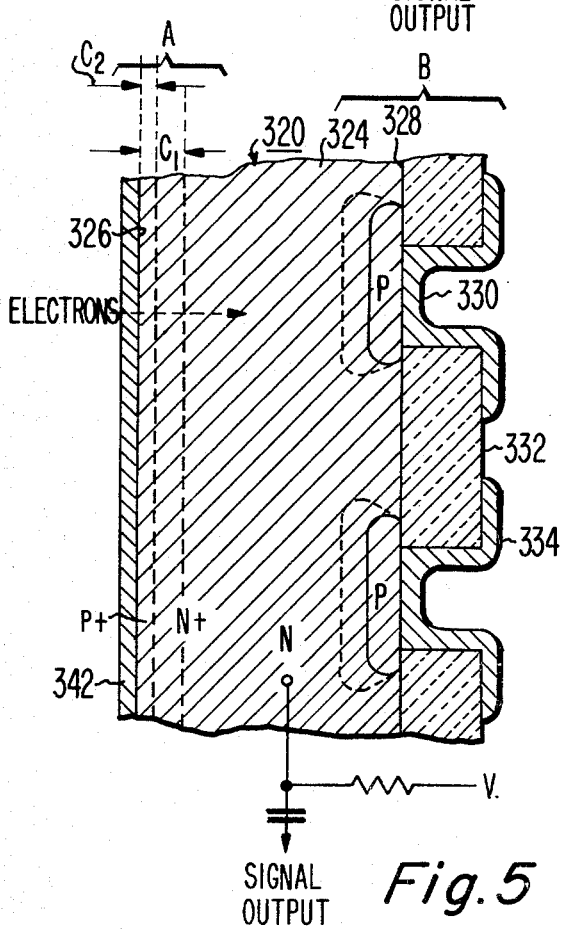

The targets depicted in 2*a*–2*b* and 3*a*–3*b* may also be employed as electron excitable targets in silicon intensifier tubes. The operation and manufacture of silicon intensifier tubes is well known in the art of electron discharge devices. Referring to FIGS. 4 and 5, there is depicted other targets suitable for incorporation in such silicon intensifier tubes. The targets of FIGS. 4 and 5 are substantially similar to the targets in FIGS. 3*a*–3*b* and 2*a*–2*b*, respectively. Similar designation numbers are employed to designate corresponding portions of each target wherein the first digit of each designation number is varied to identify each of the various embodiments. In contrast to the targets depicted in FIGS. 3*a*–3*b* and 2*a*–2*b*, respectively, FIGS. 4 and 5 each include an additional buffer or energy absorbing layer 242 and 234, respectively, the function, fabrication and theory of operation of which is fully described in U.S. Pat. No. 3,761,762 issued to W. N. Henry et al on Sept. 23, 1973 and herein incorporated by reference.

Fabrication

In general, the fabrication of single crystal semiconductor sensing elements of, for example, silicon for sensing devices is well known in the art. For example, the fabrication of targets for vidicons and image intensifier tubes employing semiconductor wafers is well known in the art of electron discharge devices. In the manufacture of targets 20, 120, 220 and 320, a silicon wafer is, for example, first fabricated to include the charge storage region "B" previously described in the manner fully described in U.S. Pat. No. 3,548,233 issued to E. F. Cave et al on Dec. 15, 1970, and herein incorporated by reference. The details of construction of the charge storage regions of these sensing elements or targets 20, 120, 220 and 320 may be varied considerably without affecting the relevance of the instant invention. For example, alternative charge storage regions "B" for theses targets may be fabricated by persons of ordinary skill in the art having the alternative structural configurations disclosed in U.S. Pat. No. 3,419,746 issued to M. H. Crowell et al on Dec. 31, 1968 and U.S. Pat. No. 3,403,284 issued to T. M. Buck et al on Sept. 24, 1968.

In contrast to the manufacture and fabrication of prior art targets, the silicon wafers of targets 20, 120, 220 and 320 are now ion implanted with a suitable doping source to include the N+ potential barrier previously described. For example, a suitable silicon wafer having a resistivity of 50 to 150 ohm-cm. bulk material with approximately $1\times10^{14}$ carriers per centimeters$^3$ may be processed to include a suitable N+ potential barrier in the following manner:

The N+ potential barrier region may be implanted into such a wafer with the desired doping profile for controlling blooming using arsenic atoms with an incident energy of about 30 KeV. The peak doping in the resulting Gaussian-shaped profile at a distance $C_1$ from the input signal sensing surface of the wafer is about $1\times10^{18}$ atoms/cm$^3$. These atoms are activated, for example, by heating or annealing the wafer in a furnace at a temperature of about 870° C. for a period of time of about 45 minutes. After such annealing, an effective active dopant level is achieved at the peak of the resultant potential barrier distribution by atoms which have become substitutional in the lattice for achieving the blooming control mechanism previously described.

In the case of the target depicted in FIG. 2*a*, the silicon wafer 25 is further processed to include a suitable P+ region 40 along the input signal sensing surface 26. A suitable P+ surface region 40, of a thickness $C_2$ less than approximately 1,000 Angstroms thick, may be obtained by placing the silicon wafer in a boron diffusion furnace at between about 800°–900° C. for a period of time of about 5 minutes. The thickness of the P+ surface region 40 may be varied considerably so long as its dopant profile does not detrimentally affect the potential barrier and its characteristics ($B_1$ and $B_2$) necessary for achieving the blooming control function. The dopant level of the P+ layer is selected to substantially fix the valence band $E_V$ substantially at the Fermi level. In other respects, the target 20 may be fabricated by techniques well known in the art.

In the case of the target depicted in FIG. 3*a*, a layer of transparent insulating material 136 is evaporated along the surface 126 of the silicon wafer for producing an inversion-like behavior in the region of the silicon wafer interfacing therewith (i.e. a P+-like region). In this case, the target 120 is processed, subsequent to the ion implantation of the N+ potential barrier previously described, by placing the silicon wafer in an evacuation system including an electron gun evaporator for evaporating a suitable material for layer 136, such as, for example, a borosilicate glass ($B_2O_3$-$S_iO_2$) to a thickness of about 500 Angstroms. One type of borosilicate glass which is considered suitable, is for example, "Vycor" (a registered trademark) manufactured by Corning Glass Works of Corning, N.Y., having a composition consisting essentially of about 96% $SiO_2$ and about 3% $B_2O_3$. Such a material has been found to possess adequate non-mobile negative charge, after deposition, to achieve the desired inversion behavior in the wafer, previously described. The thickness of the layer 36 may be varied considerably without adversely affecting the performance of the target; however, the thickness and type of insulating material is preferably selected to minimize reflections in the blue end of the light spectrum.

The targets depicted in FIGS. 4 and 5 are processed and fabricated substantially as described for the targets 120 and 20 shown in FIGS. 3*a* and 2*a*, respectively; however, an additional chromium buffer layer 242 or 342 is evaporated along the input signal sensing surfaces 226 or 326 as described in the aforementioned patent by W. N. Henry et al.

Theory of Operation

As previously stated, sensing elements of the type described are desired wherein the potential barrier for providing blooming control is located about 1500 Å or less from the input signal sensing surface in order to maximize sensitivity of the ultimate device, particularly to ultraviolet light. Unfortunately, devices which have been manufactured with potential barriers located substantially at about 1500 Å or less from the input signal sensing surface, in contrast to those having similar operative potential barriers located substantially at 3000 Å or more, have been found to have inadequate blooming control and/or other highly undesirable characteristics such as high dark current.

Figure 6:
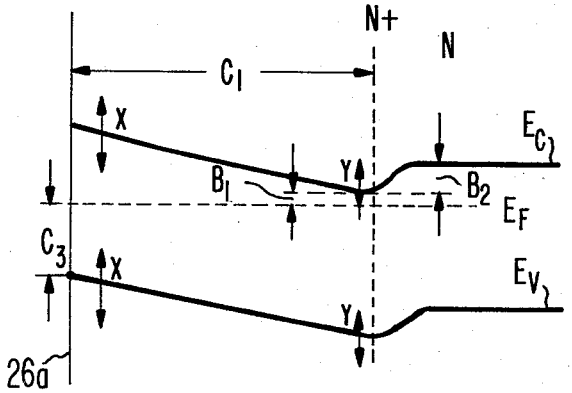
FIG. 6 is a band diagram showing the energy level configuration associated with targets not employing the invention in the region of the input signal sensing surface.

Referring to FIG. 6, it is theorized that as the potential barrier's position is located closer and closer to the input signal sensing surface 26*a* (i.e. as $C_1$ is reduced), by providing a shallower ion implant region, the height of the potential barrier becomes more sensitive to undesirable surface effects, or uncontrollable variations in such effects, which can occur along the surface region proximate to the surface 26*a*. These surface effects and changes therein, occur during processing, fabrication, and/or within the sensing element's ultimate environment, such as a tube interior of a vidicon or image intensifier tube, and are believed to be largely uncontrollable with existing technology. These surface effects and their changes or variations influence the relative position of the valence band $E_V$ and conduction bands $E_C$ relative to the Fermi-level (i.e. "the energy level configuration") at the surface 26*a* and provide an uncontrollable movement of the bands $E_V$ and $E_C$ (represented by "X") which are "reflected" into the wafer producing a similar but undesirable movement "Y" of the valence and conduction bands in the region of the potential barrier. The blooming control mechanism previously described requires that the critical value $B_1$ and $B_2$ at the potential barrier be carefully controlled. As the distance $C_1$ becomes less (i.e. approaches 1500 Å or less) the undesirable and uncontrollable variations "Y" caused by the aforementioned surface factors require corresponding changes in the characteristics $B_1$ and $B_2$ necessary to accomplish the blooming control described. Consequently, we have found that some means of "passivation" at the input signal surface region 26*a* is necessary in such sensing elements to provide a controlled and predictable blooming control mechanism whenever potential barriers of the type described are provided within about 1500 Å or less of the input signal sensing surface. Passivation, as herein defined, refers to providing electrical stability of the energy level configuration (i.e. the relative positioning of $E_C$ and $E_V$ with respect to $E_F$) in the region adjacent the wafer's input signal sensing surface, by substantially fixing the relative position of the conduction and valence band relative to the Fermi-level. More specifically, in the case of a wafer having an N-type conductivity bulk, we have found that the energy level configuration in the region adjacent the input signal sensing surface of the wafer may be effectively and easily stabilized by establishing the valence band $E_V$ substantially at the Ferm-level. Conversely, in the case of a wafer having a P-type conductivity bulk, the energy level configuration in the same region may be effectively and easily stabilized by establishing the conduction band $E_C$ substantially at the Fermi-level. As herein defined, $E_V$ or $E_C$, is considered to be located substantially at the Fermi-level whenever $C_3$ ($E_F$–$E_V$), or $E_C$–$E_F$, respectively, is less than about 0.1 eV.

Passivation of sensing elements including a potential barrier less than about 1500 Å from an input signal sensing surface may be provided by various means. For example, the targets depicted in FIGS. 2*a* and 5 are passivated by providing a P+ region along surface 26 or 326, respectively, in the wafer 24, or 324, having a doping profile which fixes the valence band substantially at the Fermi-level. In contrast, the targets depicted in FIGS. 3*a* and 4 include a layer of transparent insulating material 138, or 238, respectively, including sufficient non-mobile negative charge along the surface 126, or 226, to substantially fix the valence band at the Fermi-level along those surfaces.

General Considerations

While the preferred embodiments of the invention relate to pickup tubes such as vidicons or image intensifier tubes, the invention encompasses other types of charge storage devices which have charge storage "input signal sensing elements" addressed by a reading means. Such devices, may for example, comprise storage tubes, scan conversion tubes or solid state image sensors. The various modes of operation of the present invention as one of such devices and the voltages to be applied for such modes are well known to those skilled in the art and are discussed, for example, in the issued U.S. Pat. No. 3,403,284 to T. M. Buck et al mentioned earlier. For instance, in the secondary emission mode, the conductivity type of the discrete P regions and the N-type bulk region of the wafer 24 are reversed, so that the discrete regions are made N-type whereas the bulk regions of the wafer 24 is P-type. Also, the conductivity type of the potential barrier is reversed (i.e. a P+ potential barrier is provided). Similarly, in FIG. 2*a*, the region 40 would be made N+ whereas the layer 136 in FIG. 3*a* would be made to include non-mobile positive charge. In contrast to the earlier disclosed embodiments, the energy level configuration would be stabilized along the input signal sensing surface by fixing the conduction band substantially at the Fermi-level. Thus, in general the energy level configuration is stabilized by providing a region of opposite conductivity type (or one similar in affect by inversion) to that of the bulk of the wafer along the signal sensing surface wherein the conducting band appropriate to the minority carriers excited in the bulk of the wafer is substantially fixed at the Fermi-level along that signal sensing surface. The scan side of the target 20 is brought to the potential of an accelerating mesh of the gun 18 by secondary emission.

For optimum sensitivity of the target 20, it is desirable that the wafer thickness be less than the average carrier diffusion length in the wafer. This assures that enough of the light generated carriers will be able to reach one of the discrete regions 30. For best response to short wavelengths such as blue, or for good resolution, the wafer should be made as thin as possible. In operation, the field free region of the wafer should preferably be minimized by applying voltages to the wafer which bring the depletion region associated with each of the discrete regions 30 to the point of location of the potential barrier implanted into the surface of the wafer. In this condition, light or electron excited carriers in the field-free region will be more likely to reach the depletion regions associated with each one of the discrete regions 30. Unlike prior art targets an N+ type accumulation region for reducing surface recombination at the input signal sensing surface is not provided in the targets herein described.

The input signal sensing surface may be supplied with an anti-reflective, or transparent coating to improve the optical coupling between the target and any associated objects such as the faceplate of the vidicon or image intensifier tubes within which it is included. In the case of the vidicon target shown in FIG. 3*a*, the material selected for layer 136 is preferably made of an anti-reflective material.

In a vidicon, or image intensifier tube, the reading of the target is accomplished by contacting the individual target elements such as the diodes of the array with an electron beam. When a target has discrete elements, such as in a diode array, however, the function of the electron beam may be performed by contacting each element with an electrical conductor and then scanning the conductors with solid state circuitry. Such an arrangement is more fully described, for example, in the aforementioned U.S. Pat. No. 3,548,233 of E. F. Cave et al. Solid state scanning of this type is discussed, for example, by G. Sadasiv, P. K. Weimer, and W. S. Pike in "Thin-Film Circuits For Scanning Image-Sensor Array", *IEEE Transactions on Electron Devices*, Vol. ED-15, No. 4, April 1968. Thus, while the invention is applicable to targets from beam scanned devices, it is also applicable to solid state charge storage imaging devices such as CCD's and CID's. Similarly, the invention may also be employed for passivating the input signal sensing surfaces of semiconductor sensing elements of single or multiple line array type imaging devices. The invention may be applied to any of such imaging and/or photon excitable devices wherein a potential barrier is provided within about 1500 Å from an input signal sensing surface of a sensing element. The term "sensing element" is intended to broadly describe any element incorporating means for exciting charge carriers in accordance with electromagnetic energy (such as light in a photon-excitable device) or electrons (in an electron-excitable device) focused to impinge upon an input signal sensing surface of the element in the form of an image, without limitations as to the means of providing charge readout. The invention may be applied to such devices as photocathodes not employing any additional readout means or charge storage.

Each of the embodiments described may be operated with voltages, currents and frequencies normally used for devices of the particular type. In this respect, the targets are comparable with existing structures and do not require special treatment for successful operation.

What we claim is:

1. A charge storage device having a signal sensing element with an input signal sensing surface region and a charge storage region, and reading means for selectively contacting portions of said charge storage region, and sensing element comprising:

(a) a single crystal semiconductor wafer having
  (1) a plurality of discrete storage regions along a second surface and extending into said wafer a distance less than the wafer thickness, said discrete regions being of a first conductivity type;
  (2) a bulk region in said wafer defined as a region extending between and bounded at opposite sides by said discrete regions and said signal sensing surface region; said bulk region being of a second conductivity type;
  (3) means for controlling blooming within said signal sensing surface region comprising a region of similar conductivity type to that associated with said bulk, and having a dopant concentration exceeding that of said bulk for controlling recombination of excess carriers, excited within localized regions of said bulk, at a first opposed surface of the wafer; said dopant concentration having a peak spaced from and located less than about 1500 Å from said first surface of the wafer;

(b) passivation means for stabilizing the energy levels along said first surface of the wafer; said means substantially fixing the energy level relationship of the conducting band of the minority carriers in the bulk relative to the Fermi energy level of the semiconductor wafer.

2. The charge storage device of claim 1 wherein said conducting band is fixed substantially at the Fermi energy level of the semiconductor wafer.

3. The charge storage device of claim 2, wherein the bulk region of said wafer is of N type conductivity, said means for controlling blooming comprises an N+ region of said wafer, and wherein said passivation means comprises a P+ region along said second surface of the waver wherein the valance band is substantially fixed at the Fermi energy level of the semiconductor wafer.

4. The charge storage device of claim 3, additionally including an energy absorbing layer of chromium along said second surface of the wafer.

5. The charge storage device of claim 2, wherein said passivation means comprises a layer of transparent insulating material incorporating an effective level of non-mobile negative charge for inducing an inversion region in said wafer, along said second surface of the wafer.

6. The charge storage device of claim 5, further including an energy absorbing layer of chromium along said transparent insulating material.

7. An imaging device comprising: a wafer of single crystal semiconductor material having a bulk region of one conductivity type, the wafer having a first surface with an input signal sensing region extending into the wafer along the first surface and a second surface with a plurality of charge storage regions extending into the wafer from the second surface, the wafer also having a potential barrier in the sensing region for controlling blooming, the potential barrier extending along the first surface, said barrier having a peak spaced from and located less than about 1500 Å from the first surface; and means for passivating the energy levels of said wafer along the first surface so that the minority carrier conducting energy band level along the first surface is substantially fixed with respect to the Fermi energy level of the semiconductor material.

8. The imaging device of claim 7, wherein said conducting band is fixed substantially at the Fermi energy level of the semiconductor material.

9. The imaging device of claim 8, wherein the bulk region of said wafer is of N type conductivity, said potential barrier is an N+ region of said wafer, and wherein said means comprises a P+ region along said input sensing surface wherein the valence band is fixed substantially at the Fermi energy level of the semiconductor material.

10. The imaging device of claim 9, additionally including an energy absorbing layer of chromium along the surface of said P+ region.

11. The imaging device of claim 8, wherein said means comprises a layer of transparent insulating material incorporating an effective level of non-mobile charge for inducing an inversion region in said wafer, along said input sensing surface of said wafer.

12. An imaging device in accordance with claim 11, further including an energy absorbing layer of chromium along said transparent insulating material.

* * * * *

UNITED STATES PATENT AND TRADEMARK OFFICE

CERTIFICATE OF CORRECTION

PATENT NO. : 4,232,245

DATED : November 4, 1980

INVENTOR(S) : Eugene Diedrich Savoye et al.

It is certified that error appears in the above—identified patent and that said Letters Patent is hereby corrected as shown below:

| Patent | |
|---|---|
| Column 3, line 11 | delete "and" second occurrence; |
| Column 4, line 12 | change "234" to --342--; |
| Column 4, line 34 | change "theses" to --these--. |

| Patent | Correction |
|---|---|
| Claim 3, line 6: | change "waver" to --wafer--; |
| Claim 3, line 6: | change "valance" to --valence--. |

Signed and Sealed this

*Thirty-first* Day of *March 1981*

[SEAL]

*Attest:*

RENE D. TEGTMEYER

*Attesting Officer*

*Acting Commissioner of Patents and Trademarks*